US008221210B2

(12) United States Patent
Jubinville

(10) Patent No.: US 8,221,210 B2
(45) Date of Patent: Jul. 17, 2012

(54) LOTTERY GAME HAVING SECONDARY GAME WITH MULTIPLIER AND SECOND PAYOUT

(75) Inventor: Chantal Jubinville, Hoboken, NJ (US)

(73) Assignee: Scientific Games International, Inc., Newark, DE (US)

( * ) Notice: Subject to any disclaimer, the term of this patent is extended or adjusted under 35 U.S.C. 154(b) by 1643 days.

(21) Appl. No.: 11/074,999

(22) Filed: Mar. 8, 2005

(65) Prior Publication Data

US 2006/0205476 A1 Sep. 14, 2006

(51) Int. Cl.
*G07F 17/34* (2006.01)

(52) U.S. Cl. ..... 463/17; 463/16; 463/18; 463/19; 463/20; 463/25; 463/40; 463/41; 463/42; 463/43; 273/138.1; 273/142 B; 273/237; 273/269; 273/297

(58) Field of Classification Search ..... 463/16–20, 463/12, 13, 30, 37, 40–43, 25; 273/138.1, 273/142 B, 297, 293, 142 R, 143 R, 237, 273/269, 13.1, 142, 263
See application file for complete search history.

(56) References Cited

U.S. PATENT DOCUMENTS

| | | | |
|---|---|---|---|
| 4,805,907 | A | 2/1989 | Hagiwara |
| 4,961,578 | A | 10/1990 | Chateau |
| 4,998,199 | A | 3/1991 | Tashiro et al. |
| 5,112,050 | A | 5/1992 | Koza et al. |
| 5,116,049 | A | 5/1992 | Sludikoff et al. |
| 5,186,463 | A | 2/1993 | Marin et al. |
| 5,232,221 | A | 8/1993 | Sludikoff et al. |
| 5,259,616 | A | 11/1993 | Bergman |
| 5,273,281 | A | 12/1993 | Lovell |
| 5,332,219 | A | 7/1994 | Marnell, II et al. |
| 5,342,049 | A | 8/1994 | Wichinsky et al. |
| 5,380,007 | A | 1/1995 | Travis et al. |
| 5,393,057 | A | 2/1995 | Marnell, II |
| 5,401,024 | A | 3/1995 | Simunek |
| 5,451,052 | A | 9/1995 | Behm et al. |

(Continued)

FOREIGN PATENT DOCUMENTS

AU 29 38 307 C2 6/1982

(Continued)

OTHER PUBLICATIONS

"First Double Lotto Jackpot Pay Out Big; Search is on for $16 Million Ticket Holder", PR Newswire, Sep. 12, 1996.*

(Continued)

*Primary Examiner* — Sunit Pandya
(74) *Attorney, Agent, or Firm* — Dority & Manning, P.A.

(57) ABSTRACT

A method of play and system of implementing a primary lottery game having a secondary individual game for a multiplier value of winnings of the primary lottery game and potential secondary winnings for the secondary individual game. A player enters the primary lottery game, which can provide a first monetary winnings, and then can enter a secondary individual game that, if won, provides either a multiplier value of first monetary winnings, separate secondary monetary winnings, or both. The possible total prize amount awarded to the player includes first monetary winnings awarded from the primary lottery game multiplied by any multiplier awarded in the secondary individual game, and any secondary monetary winnings from the secondary individual game. Alternately, a win solely in the secondary individual game can yield a separate award of secondary monetary winnings, regardless if the primary lottery game has winnings.

8 Claims, 6 Drawing Sheets

U.S. PATENT DOCUMENTS

| | | | | |
|---|---|---|---|---|
| 5,456,465 | A | 10/1995 | Durham | |
| 5,486,005 | A | 1/1996 | Neal | |
| 5,513,846 | A | 5/1996 | Niederlein et al. | |
| 5,540,442 | A | 7/1996 | Orselli et al. | |
| 5,564,700 | A | 10/1996 | Celona | |
| 5,613,679 | A * | 3/1997 | Casa et al. | 273/138.1 |
| 5,655,961 | A | 8/1997 | Acres et al. | |
| 5,722,891 | A | 3/1998 | Inoue | |
| 5,732,948 | A | 3/1998 | Yoseloff | |
| 5,741,183 | A | 4/1998 | Acres et al. | |
| 5,743,800 | A | 4/1998 | Huard et al. | |
| 5,752,882 | A | 5/1998 | Acres et al. | |
| 5,770,533 | A | 6/1998 | Franchi | |
| 5,772,509 | A | 6/1998 | Weiss | |
| RE35,864 | E | 7/1998 | Weingardt | |
| 5,797,794 | A | 8/1998 | Angell | |
| 5,820,459 | A | 10/1998 | Acres et al. | |
| 5,823,874 | A | 10/1998 | Adams | |
| 5,830,063 | A | 11/1998 | Byrne | |
| 5,833,537 | A | 11/1998 | Barrie | |
| 5,836,817 | A | 11/1998 | Acres et al. | |
| 5,848,932 | A | 12/1998 | Adams | |
| 5,876,284 | A | 3/1999 | Acres et al. | |
| 5,882,261 | A | 3/1999 | Adams | |
| 5,911,418 | A | 6/1999 | Adams | |
| 5,996,997 | A * | 12/1999 | Kamille | 273/139 |
| 6,004,207 | A | 12/1999 | Wilson, Jr. et al. | |
| 6,012,982 | A | 1/2000 | Piechowiak et al. | |
| 6,077,162 | A | 6/2000 | Weiss | |
| 6,086,477 | A * | 7/2000 | Walker et al. | 463/17 |
| 6,089,978 | A | 7/2000 | Adams | |
| 6,142,872 | A | 11/2000 | Walker et al. | |
| 6,146,270 | A * | 11/2000 | Huard et al. | 463/12 |
| 6,149,521 | A | 11/2000 | Sanduski | |
| 6,179,710 | B1 | 1/2001 | Sawyer et al. | |
| 6,210,276 | B1 * | 4/2001 | Mullins | 463/27 |
| 6,217,448 | B1 | 4/2001 | Olsen | |
| 6,227,969 | B1 | 5/2001 | Yoseloff | |
| 6,238,288 | B1 | 5/2001 | Walker et al. | |
| 6,296,569 | B1 * | 10/2001 | Congello, Jr. | 463/17 |
| 6,309,300 | B1 | 10/2001 | Glavich | |
| 6,334,814 | B1 | 1/2002 | Adams | |
| 6,340,158 | B2 | 1/2002 | Pierce et al. | |
| 6,375,568 | B1 | 4/2002 | Roffman et al. | |
| 6,416,408 | B2 * | 7/2002 | Tracy et al. | 463/16 |
| 6,416,409 | B1 * | 7/2002 | Jordan | 463/27 |
| 6,419,579 | B1 | 7/2002 | Bennett | |
| 6,588,747 | B1 * | 7/2003 | Seelig | 273/138.1 |
| 6,648,753 | B1 * | 11/2003 | Tracy et al. | 463/16 |
| 6,969,318 | B1 * | 11/2005 | Packes et al. | 463/25 |
| 2004/0092310 | A1 * | 5/2004 | Brosnan et al. | 463/42 |
| 2006/0246997 | A1 * | 11/2006 | Packes et al. | 463/17 |

FOREIGN PATENT DOCUMENTS

| | | | |
|---|---|---|---|
| AU | 18428/92 | | 12/1992 |
| AU | 21070/92 | | 10/1993 |
| AU | 52499/96 | | 2/1997 |
| AU | 199716432 | | 9/1997 |
| AU | 0 798 676 | A1 | 10/1997 |
| AU | 50327/96 | | 10/1997 |
| AU | 45403/97 | | 6/1998 |
| AU | 0 874 337 | A1 | 10/1998 |
| AU | 63553/98 | | 10/1998 |
| AU | 0 896 304 | A2 | 2/1999 |
| AU | 0 919 965 | A2 | 6/1999 |
| DE | 30 35 898 | A1 | 4/1982 |
| DE | 30 35 947 | A1 | 5/1982 |
| DE | 3415 114 | A1 | 10/1985 |
| DE | 29 38 307 | C3 | 7/1987 |
| DE | 38 22 636 | A1 | 1/1990 |
| DE | 197 06 286 | A1 | 5/1990 |
| DE | 298 03 107 | U1 | 9/1998 |
| DE | 298 16 453 | U1 | 4/1999 |
| DE | 197 51 746 | A1 | 5/1999 |
| ES | 529535 | | 6/1983 |
| ES | 529536 | | 6/1983 |
| ES | 2 006 400 | | 4/1989 |
| ES | 2 006 401 | | 4/1999 |
| GB | 2 230 373 | A | 10/1990 |
| GB | 2 222 712 | B | 6/1992 |
| GB | 2 295 775 | A | 6/1996 |
| GB | 2 328 2311 | A | 2/1999 |
| WO | WO 91/17529 | | 11/1991 |
| WO | WO 98/40138 | | 9/1998 |

OTHER PUBLICATIONS

Vejnoska, Jill "Georgia Powerball; Confusion or cash awaits game players", The Atlanta Journal and Constitution, Sep. 2, 1995, Local News, p. 2C.*

"Are You In?" flyer facsimile transmission from Maryland Lottery to Hagerstown Mini Storage, 2 pages, transmission date of Feb. 20, 1998.

Website entitled "Oregon Lottery Megabucks—How to Play" last updated on Jul. 31, 2000 located at http:/www.oregonlottery.org/mega/mhowto.htm.

* cited by examiner

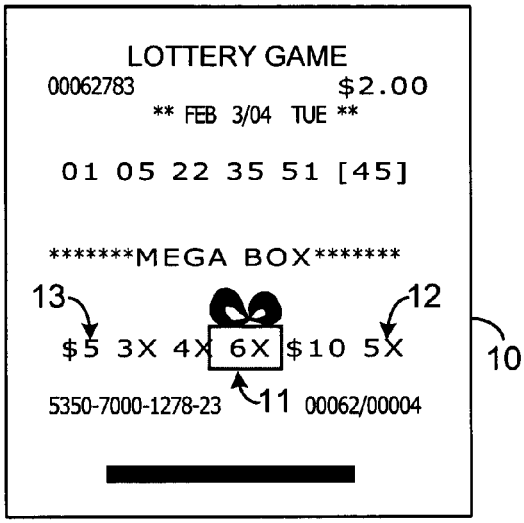
Fig. 1
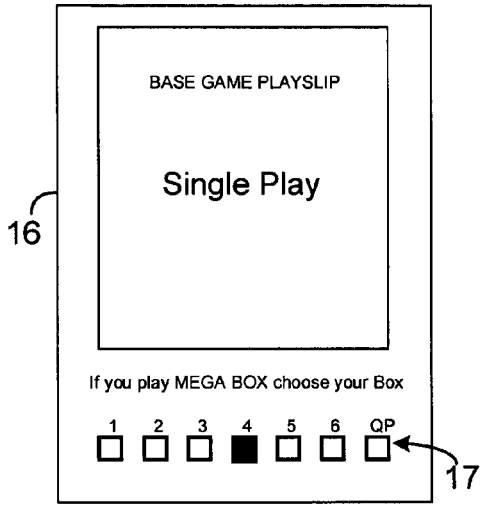
Fig. 2
| | Prize | Weight | Prob | 1/Prob | % Return |
|---|---|---|---|---|---|
| Cash | $10 | 1 | 0.01 | 100.00 | 10.0% |
| | $5 | 2 | 0.02 | 50.00 | 10.0% |
| Multipliers | 3 | 60 | 0.60 | 1.67 | 22.0% |
| | 4 | 28 | 0.28 | 3.57 | 15.4% |
| | 5 | 8 | 0.08 | 12.50 | 5.9% |
| | 6 | 1 | 0.01 | 100.00 | 0.9% |
| | | 100 | | | 64.1% |
Fig. 4

| | Overall odds |
|---|---|
| Cash Prize | 33.33 |
| Multiplier >= 3 | 1.03 |
| >= 4 | 2.70 |
| >= 5 | 11.11 |
| = 6 | 100.00 |

| | Prize 1 | | Prize 2 | | Prize 3 | | Prize 4 | | Prize 5 | | Prize 6 | |
|---|---|---|---|---|---|---|---|---|---|---|---|---|
| | Value | Probability | Value | Probability | Value | Probability | Value | Probability | Value | Probability | Value | Probability |
| Outcome 1 | 2 X | 93.4% | 2 X | 89.3% | 2 X | 96.1% | 3 X | 79.7% | 3 X | 60.5% | 3 X | 96.1% |
| Outcome 2 | 5 X | 6.6% | $5 | 10.7% | $10 | 3.9% | 4 X | 20.3% | 4 X | 39.5% | $2 | 3.9% |

Fig. 11

LOTTERY GAME HAVING SECONDARY GAME WITH MULTIPLIER AND SECOND PAYOUT

BACKGROUND OF THE INVENTION

1. Field of the Invention

The present invention generally relates to games of chance, to include Lotteries. More particularly, the present invention relates to a system and method for implementing a primary lottery game that has a secondary incorporated game primarily to provide a multiplier value for winnings from the primary lottery game and/or secondary winnings from the play of the secondary game.

2. Description of the Related Art

In known wagering games, each individual entrant places a wager on the outcome of an event such as a roll of dice, a selection of one or more randomly generated indicia such as cards or numbers, a horse or dog race, a Jai Alai game, a sporting event, or the like, and the wager is won or lost depending on the outcome of the event. Typically, entrants are able to place their wagers on one or more of several possible outcomes of an event such that the actual outcome creates both winners and losers among the group of entrants of a particular game. Some wagering games are designed around a particular apparatus such that the entrants must seek out a gaming table or machine in order to play. Other games can be played anywhere people are gathered and wagering is available. Regardless of the game being played or the venue in which it is presented for wagering, there is a need for a gaming method that will attract new entrants to wagering games and hold the attention of existing entrants so that such games remain attractive relative to the many new games and diversions constantly being developed.

Many governments and/or gaming organizations sponsor wagering games known as lotteries. A typical lottery game entails players selecting permutations or combinations of numbers. This is followed by a "draw," wherein the lottery randomly selects a combination or permutation of numbered balls. Prizes are awarded based on the number of matches between a player's selections and the drawn numbers. Examples are the well-publicized, multi-million-dollar-jackpot lotteries popular throughout the world.

Lotteries have also become an important source of income to governments as they shoulder much of the financial burden for education and other programs. As governments have grown more dependent on lotteries it has become a challenge to sustain public interest. One approach to invigorating lottery sales is to expand game content beyond traditional combination/permutation games. The new games may help keep current players, as well as draw in new players.

Because the development of new games and diversions is costly and time consuming without any certain outcome of whether the game will be accepted by the gaming public, the use of a bonus feature on established and accepted games is desirable. Bonus features take many forms. In one extant embodiment, a lottery game can have a secondary game associated with it where the secondary game provides a multiplier to winnings from the lottery game. The secondary game could be played with the drawing of an extra ball from a ball machine and the ball has a number value on it, or a color value, indicating the value of the multiplier. Since this bonus feature is only available to those players who achieve the predetermined winning outcome, a player who has not achieved the bonus initiating winning outcome typically becomes bored and is more likely to cease playing the game. There is, therefore, a need to provide a bonus game in which a bonus or winning outcome is established prior to the initiation of the primary individual event, and in which a bonus or additional winnings can be awarded to all subsequent winning combinations of the primary event.

SUMMARY OF THE INVENTION

Briefly described, the present invention is a system and method of implementing a primary lottery game that has a secondary individual game available to the player of the primary lottery game, and the secondary individual game is for a multiplier value of winnings of the primary lottery game and a secondary winnings for the secondary individual game. A player enters the primary lottery game, which can provide a first monetary winnings, and then can enter a secondary individual game that, if won, provides either a multiplier value of the first monetary winnings, separate secondary monetary winnings, or both. In one embodiment, the possible total prize amount awarded to the player includes first monetary winnings awarded from the primary lottery game multiplied by any multiplier awarded in the secondary individual game, and any secondary monetary winnings from the secondary individual game. Alternately, even if there is not a win in the primary lottery game, a win can occur solely in the secondary individual game to yield a separate award of secondary monetary winnings.

In one embodiment, the invention includes a method of playing a primary lottery game having a secondary individual game for a multiplier value of the winnings of the primary lottery game and a secondary winnings, including the steps of receiving entries from a plurality of entrants for a primary lottery game wherein each of the entrants has made a wager on an outcome of the primary lottery game, and the primary lottery game provides a first monetary winnings, then receiving an additional entry from at least one entrant to participate in the secondary individual game to the primary lottery game, wherein the at least one entrant has made a wager on the outcome of the secondary individual game, and the secondary individual game provides a multiplier value of the first monetary winnings of the primary lottery game and one or more secondary monetary winnings. Then the method includes the step of determining whether a winning outcome is achieved in the primary lottery game and if a first monetary prize is awarded. For each at least one entrant participating in the secondary individual game, the methods includes the step of determining whether a winning outcome is achieved and if a multiplier value of the first monetary winnings is awarded and if secondary monetary winnings are awarded, then determining for each entrant a total prize amount composed of first monetary winnings awarded from the primary lottery game multiplied by any multiplier awarded in the secondary individual game, and any secondary monetary winnings from the secondary individual game. Finally, the method concludes by paying each entrant their respective total prize amount.

In one embodiment, the invention includes a system for hosting a primary lottery game having a secondary individual game through at least one terminal by which players of a primary lottery game, which provides first monetary winnings, place entries into the primary lottery game, and the terminal further allows players of the primary lottery game to selectively enter a secondary individual game for a multiplier value of the first monetary winnings of the primary lottery game and a secondary monetary winnings. The system includes at least one server that receives entries from the at least one terminal for players of the primary lottery game and players participating in the primary lottery game and secondary individual game, and the server further determines, for each player, whether a winning outcome is achieved and if a multiplier value of the first monetary winnings is awarded and if secondary monetary winnings are awarded. The server also determines, for each player, a total prize amount composed of any first monetary winnings awarded from the primary lottery game multiplied by any multiplier awarded in the secondary individual game, and any secondary monetary winnings from the secondary individual game.

The present invention is advantageous because it provides the use of a bonus feature on established and accepted lottery games. In one embodiment, the game and system of implementation allow for a secondary game that can have winnings of its own, separate from the primary lottery game, which maintains player interest in the primary lottery game. Moreover, the secondary individual game of the present invention can be easily implemented and utilize the game indicia of the primary lottery game such that no secondary drawings or game play is necessary to play the secondary individual game.

Other objects, advantages, and features of the present invention will become apparent after review of the herein after set forth Brief Description of the Drawings, Detailed Description of the Invention, and the Claims.

BRIEF DESCRIPTION OF THE DRAWINGS

FIG. 1 is an example of a printed lottery ticket with a secondary individual game in which the player chooses the location of a box in which a multiplier or cash prize are assigned.

FIG. 2 is an example of a play slip which the player enters the primary lottery game and also designates a box position for the secondary individual game.

FIG. 4 is an example of an award table for the secondary individual game with the prizes, weighting, and corresponding probabilities of winning illustrated for the secondary individual game (box) shown in FIGS. 1 and 2.

FIG. 11 is an example of probability distribution for the prizes selection that will be randomly assigned to the boxes for the secondary individual game shown in FIGS. 9 and 10.

DETAILED DESCRIPTION OF THE INVENTION

Figures 3, 5:
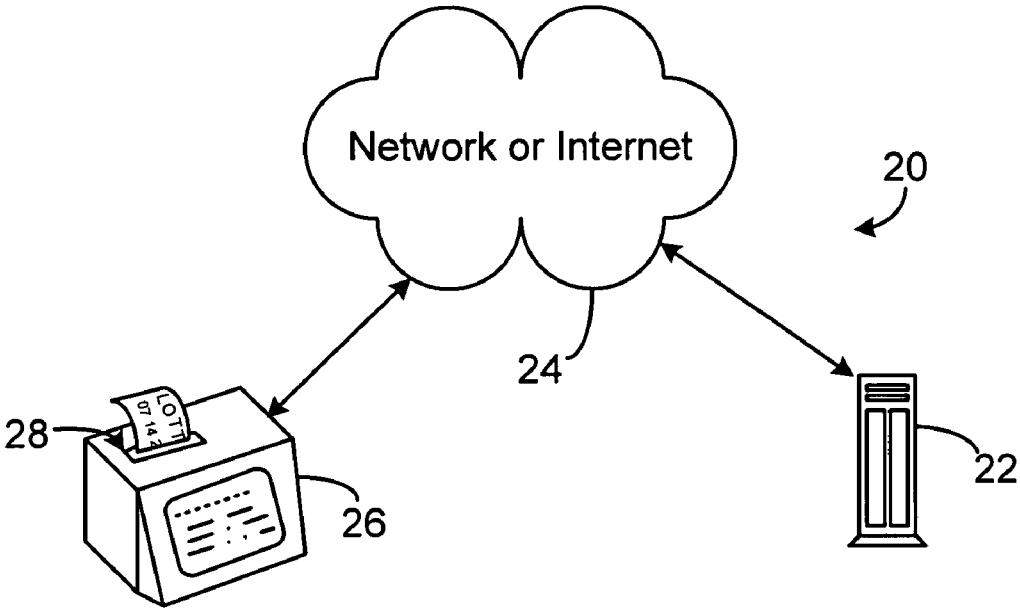
FIG. 3 is a diagram of a system implementing the primary lottery game and secondary individual game at a lottery terminal located remotely from a server.
FIG. 5 is an example of a table illustrating the odds of winning cash prizes or a specific multiplier of the first monetary winnings of the primary lottery game.

With reference to the drawings, in which like numerals represent like elements throughout, the invention is for a primary lottery game having a secondary individual game for a multiplier value of winnings of the primary lottery game and a secondary winnings. FIG. 1 is an example of a printed lottery ticket 10 with a secondary individual game in which the player chooses the location of a box 11 in which a multiplier 12 or prize 13 are placed. FIG. 2 is a play slip 16 with which the player enters the primary lottery game and also designates a box position, as shown at check boxes 17 for the secondary individual game.

In this embodiment, the illustrated "Mega Box" game is an extension that can be attached to any lotto type game with a Jackpot, or monetary winnings. For an extra $1, the player chooses or "quick-picks" (i.e. has the system pick at random) 1 out of six boxes on the playslip 16. Each one of these boxes (check boxes 17) corresponds to a unique prize on the lottery ticket 10, such as multiplier 12 or cash prize 13. As shown in this embodiment, there are different prizes distributed on the lottery ticket 10. The player wins the prize placed in the box 11 that he selected. Thus, he is awarded his "Mega Box" prize at the time of purchase.

The multipliers 12 may or may not be applicable to the Jackpot or other prizes, as desired by the game operator. Further, in this embodiment, all possible prizes are revealed on the player's lottery ticket 10, and the player always wins something (here, at least a 3× multiplier of the primary lottery game monetary winnings). It is also commercially advantageous, as the player will carry around a "winning" lottery ticket 10 until the drawing for the primary lottery game.

FIG. 4 is an award table for the secondary individual game of the "mega box" embodiment of FIGS. 1 and 2, with the prizes, weighting, and corresponding probabilities of winning illustrated for the secondary individual game shown. FIG. 5 is a table illustrating the probability of winning a specific multiplier of the first monetary winnings of the primary lottery game. The probabilities disclosed in the tables herein are merely exemplary and are not preferred or required in order to effect the secondary individual game.

Thus, as shown in FIGS. 1 and 2, the primary lottery game receives entries from a plurality of entrants for a primary lottery game wherein each of the entrants has made a wager on an outcome of the primary lottery game, and the primary lottery game provides a first monetary winnings (such as a jackpot). The game operator then receives an additional entry from at least one entrant to participate in the secondary individual game to the primary lottery game, such as through entries on playslip 16. The secondary individual game, or here the "mega box," provides a multiplier value of the first monetary winnings of the primary lottery game and one or more secondary monetary winnings (prize 13). The game operator determines whether a winning outcome is achieved in the primary lottery game and if a first monetary prize is awarded, and for each entrant participating in the secondary individual game, determines whether a winning outcome is achieved and if a multiplier value of the first monetary winnings (multiplier 12) is awarded and if secondary monetary winnings are awarded, and then determining for each entrant a total prize amount composed of any first monetary winnings awarded from the primary lottery game multiplied by any multiplier 12 awarded in the secondary individual game, and any secondary monetary winnings 13 from the secondary individual game, then paying each entrant the respective total prize amount for that entrant.

For "Mega Box," there are various methods by which a prize is assigned to the player-selected box. For example, in the embodiment described in FIGS. 1-4, the prize is reversed mapped, i.e. the player's selection has nothing to do with the prize he is awarded. A prize is determined independently of the player's selection such as by a probability distribution. FIG. 4 is such a probability distribution. (For example, a multiplier of 3 is assigned a probability of 0.01, meaning for 0.01 of the tickets a multiplier of 3 will be assigned to the player-selected box.) The prize having been determined, it is assigned to the box selected by the player. When the ticket is printed, the assigned prize appears in the box the player selected along with other prizes corresponding the boxes the player did not select.

FIG. 3 is a diagram of a system 20 implementing the primary lottery game and secondary individual game at a lottery terminal 26 located remotely from a server 22. The exemplary terminal 26 is shown as a ticket dispensing terminal through which players of the primary lottery game place entries therein and receive paper tickets 28, such as lottery ticket 10 in FIG. 1, and the terminal 26 further allows the players to selectively enter the secondary individual game for a multiplier value. At least one server 22 receives entries from the terminal 26 for the players of the primary lottery game and those that participate in the primary lottery game and secondary individual game. The server 22 determines, for each player, whether a winning outcome is achieved and if a multiplier value of the first monetary winnings is awarded and if secondary monetary winnings are awarded. The server 22 also determines, for each player, a total prize amount composed of any first monetary winnings awarded from the primary lottery game multiplied by any multiplier awarded in the secondary individual game, and any secondary monetary winnings from the secondary individual game. It should be appreciated that more than one server or computer device can perform, either in parallel or singly, any of these functions.

Figure 6:
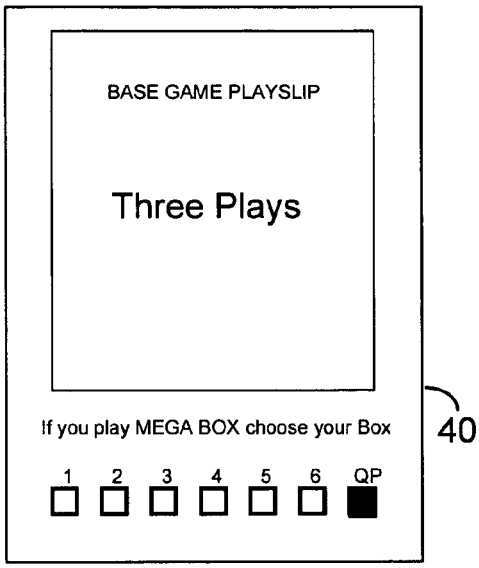
FIG. 6 is an example of a play slip for a multiple play of the primary lottery game and secondary individual game which has a "quick pick" option in which during each round of the secondary individual game play, the system randomly chooses the location of a box in which a multiplier or cash prize are assigned.
Figure 7:
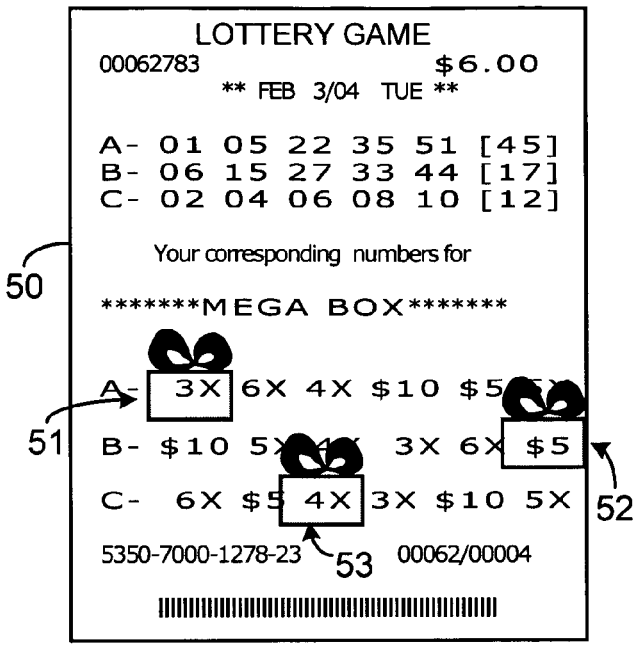
FIG. 7 is an example of a printed lottery ticket generated from the play slip of FIG. 6 for three game plays with the secondary individual game having the prize boxes randomly assigned.
Figure 8:
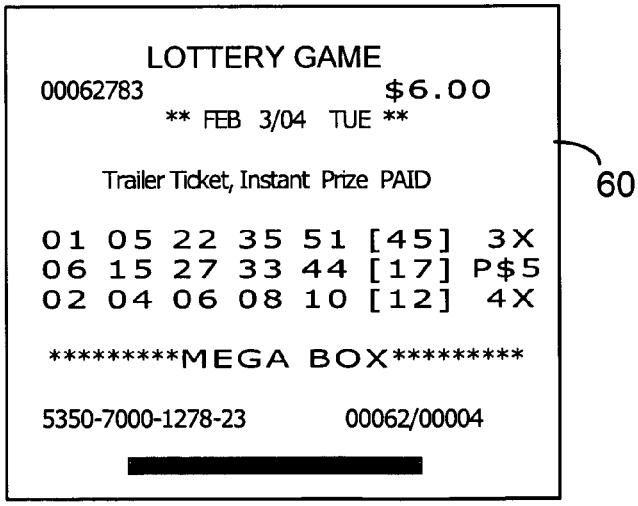
FIG. 8 is an example of a ticket based upon a secondary monetary winnings from the secondary individual game of FIG. 7.

FIG. 6 is a play slip 40 for a multiple play of the primary lottery game and secondary individual game which has a "quick pick" option in which during each round of the secondary individual game play, the system 20 randomly chooses the location of a box in which a multiplier or prize are placed. Once the playslip 40 in FIG. 6 is entered into the system 20, a lottery ticket, such as the one shown in FIG. 7 is produced. FIG. 7 is an example of a printed lottery ticket 50 for three game plays with the secondary individual game having the prize boxes 51,52,53 randomly placed. As shown by the prize boxes, in the first round, box 51 won a 3-times multiplier; in the second round, box 52, a $5 cash prize was won, and in the third round, box 53, a 4-times multiplier was won. Consequently, the lottery ticket 60 of FIG. 8 is created based upon a secondary monetary winnings from the secondary individual game of FIG. 7.

Figure 9:
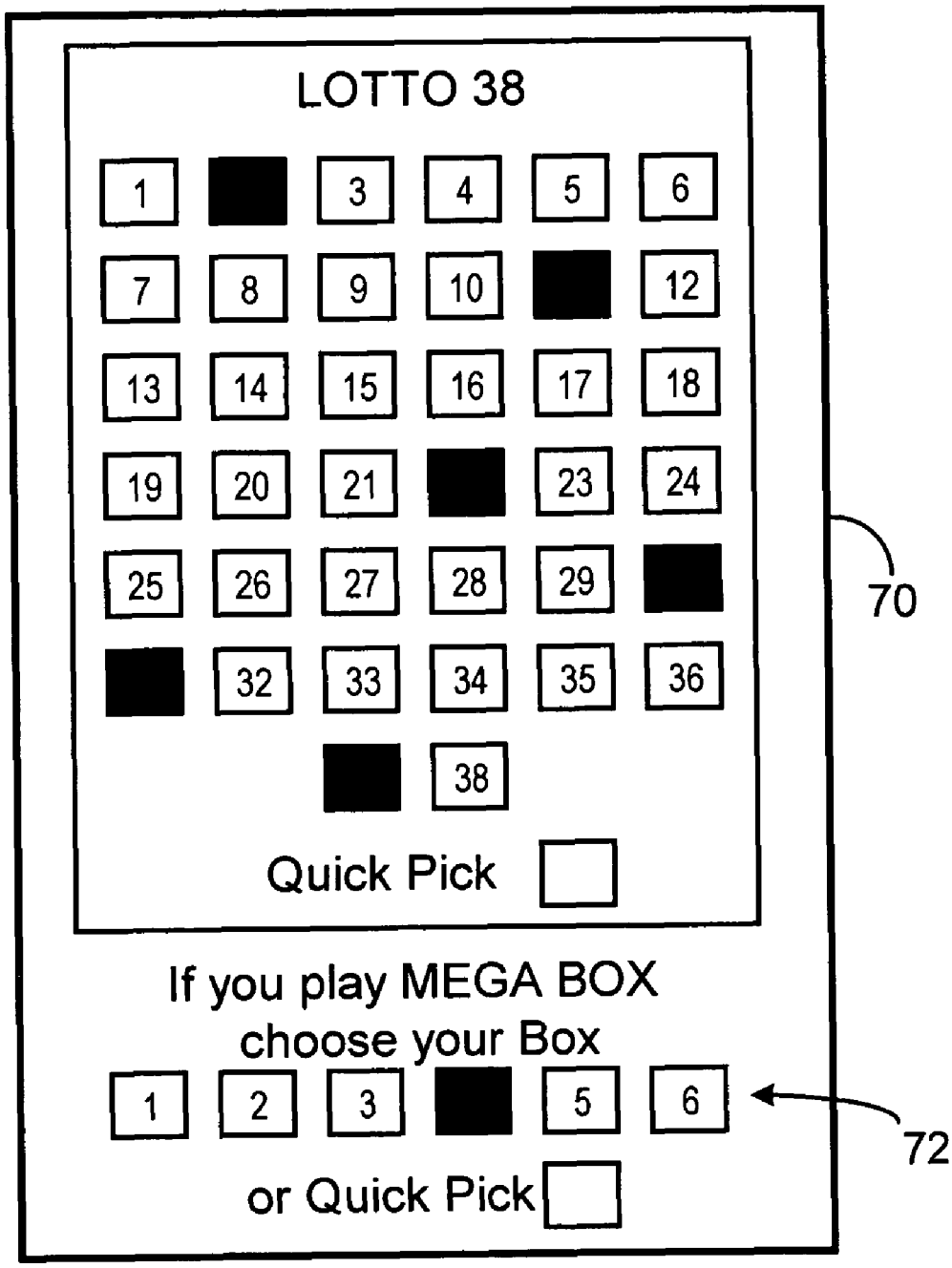
FIG. 9 is another example of a play slip which the player enters the primary lottery game and also designates a box position for the secondary individual game.
Figure 10:
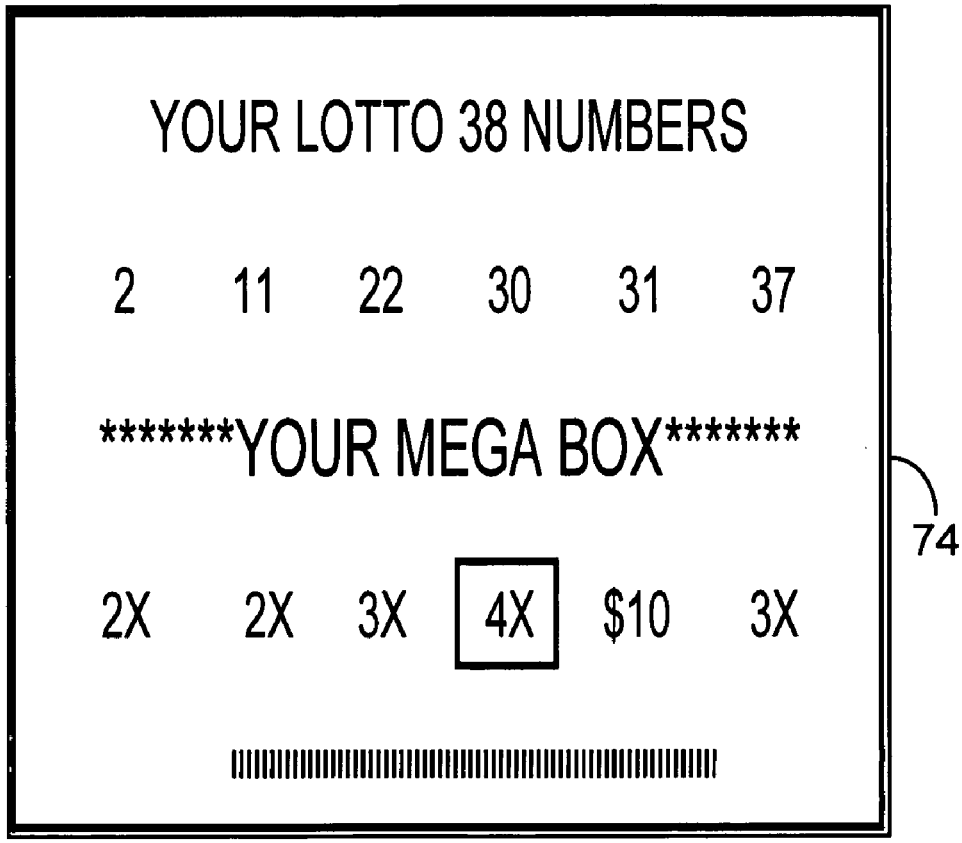
FIG. 10 is another example of a printed lottery ticket with a secondary individual game in which the player chooses the location of a box in which a multiplier or cash prize are assigned.

Alternatively, the player could select the prize of the secondary game at random. That is, the boxes are assigned prizes in advance, or independently, of the player's selection. As an example, consider the following "Mega Box" embodiment: The base game comprises a typical draw-based lottery game wherein 6 balls are drawn from 38. In addition to a jackpot prize for matching 6, players are awarded $1,000 for matching 5, $25 for matching 4, $2 for matching 3. Those skilled in the art of Mathematics can verify that the lower-tier return for this game is 20.87%. The player can purchase a "Mega Box" extension for an additional $1 for which he will receive either a multiplier to be applied to the lower-tier prizes for the base game or an instant cash prize. An exemplary playslip 70 is shown in FIG. 9. In addition to the indicia for the base game, the player selects 1 from a set of 6 boxes 72, which will yield an exemplary printed lottery ticket 74 such as that shown in FIG. 10.

Independently of the player's selection, the boxes are assigned prize values based on the scheme described in FIG. 11: First, 6 prizes are selected based on the various probability distributions. For example, Prize 1 is assigned a 2 multiplier 89.3% of the time and a cash prize of $2 the remainder of the time. Then these 6 prizes are randomly assigned to the 6 boxes from which the player selects. Unlike the embodiment that uses the reverse mapping, the player can look at his ticket and see which prize he would have received had he chosen another box.

It should be noted that the number of boxes used in this embodiment is essentially arbitrary. For example, the secondary game could be implemented for 100 boxes if the space on the ticket were available. The number of boxes from which the player has to choose and that are displayed on a ticket is matter of aesthetics and available space. It should also be noted that the secondary game is different from a plain multiplier game in that a multiplier awarded in the secondary game applies only to the individual ticket, as opposed to an entire group of players. Also, it is not necessary that the secondary game be optional; for example, instead of an additional $1, it could be included as part of a $2 game.

While there has been shown a preferred and alternate embodiment of the present invention, it is to be understood that certain changes may be made in the form and arrangement of the elements of the present invention without departing from the underlying spirit and scope of the invention as set forth in the Claims appended hereto. Furthermore, although elements of the invention may be described or claimed in the singular, the plural is contemplated unless limitation to the singular is explicitly stated.

What is claimed is:

1. A method of playing a primary lottery game having a secondary individual game for either a multiplier value of the winnings of the primary lottery game or a secondary winnings, comprising the steps of:

providing a terminal for receipt of entries from a plurality of entrants for a primary lottery game wherein each of the entrants has made a wager on an outcome of the primary lottery game, and the primary lottery game providing a first monetary winnings;

receiving an additional entry via the terminal from at least one entrant to participate in the secondary individual game to the primary lottery game, wherein the at least one entrant has made a wager on the outcome of the secondary individual game, the entries in the primary lottery game and the secondary lottery game conveyed to a server that is in communication with the terminal, and wherein the outcome of the secondary individual game is randomly selected by the server from the possibilities of either a multiplier value of the first monetary winnings of the primary lottery game or a secondary monetary winning that is independent of the outcome of the primary lottery game and the outcome being either the multiplier value or the secondary monetary winning is unknown to the player at the time of wagering on the secondary individual game;

determining via the server whether a winning outcome is achieved in the primary lottery game and if a first monetary prize is awarded;

for each of the at least one entrant participating in the secondary individual game, determining via the server whether the outcome of the secondary individual game is a multiplier value of the first monetary winnings or a monetary winning;

determining via the server for each entrant a total prize amount composed of either: a) any first monetary winnings awarded from the primary lottery game multiplied by a multiplier awarded in the secondary individual game, b) any first monetary winnings awarded from the primary lottery game and any secondary monetary winnings from the secondary individual game, or c) any secondary monetary winnings from the secondary individual game; and paying each entrant the respective total prize amount for that entrant.

2. The method of claim 1, wherein the prize for the secondary game is awarded at the time of entry if the prize for the secondary game is a monetary winning.

3. The method of claim 1, wherein a multiplier awarded by the secondary game only applies to some of the possible prizes for the primary game.

4. A system for hosting a primary lottery game having a secondary individual game, comprising:

at least one terminal through which players place entries into the primary lottery game, the primary lottery game providing first monetary winnings, and the terminal further allowing players of the primary lottery game to selectively enter a secondary individual game wherein the outcome is unknown to the player at the time of entering the secondary individual game and randomly selected from the possibilities of either a multiplier value of the first monetary winnings of the primary lottery game or a secondary monetary winning that is independent of the outcome of the primary lottery game;

at least one server that receives entries from the at least one terminal for players of the primary lottery game and players participating in the primary lottery game and secondary individual game, the server further determining, for each player, whether a winning outcome is achieved in the primary lottery game, and for the secondary individual game whether a multiplier value of the first monetary winnings is awarded or if secondary monetary winnings are awarded independent of the outcome of the primary lottery game, and the server further determining for each player a total prize amount that is either: a) any first monetary winnings awarded from the primary lottery game multiplied by any multiplier awarded in the secondary individual game, b) any first monetary winnings awarded from the primary lottery game and any secondary monetary winnings from the secondary individual game, or c) any secondary monetary winnings from the secondary individual game.

5. The system of claim 4, wherein the server further generating game results for the primary lottery game and secondary individual game, and for each player participating in the secondary individual game, the server further determining whether a winning outcome of the secondary individual game is achieved is based upon the game results of the secondary individual game.

6. The system of claim 4, wherein the prize for the secondary game is awarded at the time of entry if the prize for the secondary game is a monetary winning.

7. The system of claim 4, wherein a multiplier awarded by the secondary game only applies to some of the possible prizes for the primary game.

8. A system for playing a primary lottery game having a secondary individual game for either a multiplier value of the winnings of the primary lottery game or a secondary winnings, comprising:

means for receiving entries from a plurality of entrants for a primary lottery game wherein each of the entrants has made a wager on an outcome of the primary lottery game, and the primary lottery game providing a first monetary winnings;

means for receiving an additional entry from at least one entrant to participate in the secondary individual game to the primary lottery game, wherein the at least one entrant has made a wager on the outcome of the secondary individual game, wherein the outcome of the secondary individual game is unknown to the player at the time of wagering on the secondary individual game and randomly selected from the possibilities of either a multiplier value of the first monetary winnings of the primary lottery game or a secondary monetary winnings;

means for determining whether a winning outcome is achieved in the primary lottery game and if a first monetary prize is awarded;

for each at least one entrant participating in the secondary individual game, means for determining whether the outcome is a multiplier value of the first monetary winnings is awarded or a secondary monetary winnings that is independent of the outcome of the primary lottery game; and means for determining for each entrant a total prize amount that is either a): any first monetary winnings awarded from the primary lottery game multiplied by any multiplier awarded in the secondary individual game, b) any first monetary winnings awarded from the primary lottery game and any secondary monetary winnings from the secondary individual game, or c) any secondary monetary winnings from the secondary individual game.

* * * * *